US009164417B2

(12) United States Patent
Suzuki et al.

(10) Patent No.: US 9,164,417 B2
(45) Date of Patent: Oct. 20, 2015

(54) IMAGE FORMING APPARATUS WITH DEVELOPER BEARING MEMBER VELOCITY CONTROL

(71) Applicant: CANON KABUSHIKI KAISHA, Tokyo (JP)

(72) Inventors: Shinya Suzuki, Abiko (JP); Tadashi Fukuda, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/869,251

(22) Filed: Apr. 24, 2013

(65) Prior Publication Data

US 2013/0302053 A1 Nov. 14, 2013

(30) Foreign Application Priority Data

May 14, 2012 (JP) ..... 2012-110628

(51) Int. Cl.

| | |
|---|---|
| ***G03G 15/09*** | (2006.01) |
| ***G03G 15/08*** | (2006.01) |
| ***G03G 15/00*** | (2006.01) |
| *G03G 15/06* | (2006.01) |

(52) U.S. Cl.

CPC ..... *G03G 15/08* (2013.01); *G03G 15/0806* (2013.01); *G03G 15/09* (2013.01); *G03G 15/0907* (2013.01); *G03G 15/5008* (2013.01); *G03G 15/065* (2013.01)

(58) Field of Classification Search

CPC ..... G03G 15/0806; G03G 15/09; G03G 15/0907; G03G 15/5008; G03G 2215/00075; G03G 15/08

USPC ..... 399/53, 55, 267, 270, 279, 285

See application file for complete search history.

(56) References Cited

U.S. PATENT DOCUMENTS

| | | | | |
|---|---|---|---|---|
| 7,254,350 | B2 * | 8/2007 | Kawamura et al. | 399/55 |
| 7,317,889 | B2 * | 1/2008 | Suzuki | 399/236 |
| 7,366,446 | B2 * | 4/2008 | Sato et al. | 399/167 |
| 8,725,015 | B2 * | 5/2014 | Kabashima | 399/44 |
| 2012/0155900 | A1 * | 6/2012 | Suzuki | 399/53 |

FOREIGN PATENT DOCUMENTS

| | | | |
|---|---|---|---|
| JP | 09244382 | A * | 9/1997 |
| JP | 2001-215799 | A | 8/2001 |
| JP | 2002-116626 | A | 4/2002 |
| JP | 2003057923 | A * | 2/2003 |

(Continued)

*Primary Examiner* — Robert Beatty

(74) *Attorney, Agent, or Firm* — Fitzpatrick, Cella, Harper & Scinto

(57) ABSTRACT

An image forming apparatus of a representative configuration of the present invention includes a photosensitive drum, which carries an electrostatic latent image, and a developing sleeve, which carries a two-component developer and develops the electrostatic latent image on the photosensitive drum into a toner image. Moving directions of the photosensitive drum and the developing sleeve are opposite at an opposing portion in a developing device having a speed changing portion, which changes the driving speed of the developing sleeve, and a controller, which switches a target speed of the developing sleeve so that it is driven at a second velocity, before it is driven at the first velocity set in a lower speed mode, when the lower speed mode is executed in which the photosensitive drum is driven at a lower speed than in the normal image forming.

6 Claims, 10 Drawing Sheets

(56) References Cited

FOREIGN PATENT DOCUMENTS

| | | | | |
|---|---|---|---|---|
| JP | 3647345 | B2 | | 5/2005 |
| JP | 4065481 | B2 | | 3/2008 |
| JP | 2009025378 | A | * | 2/2009 |
| JP | 4343376 | B2 | | 10/2009 |
| JP | 2001-215798 | A | | 8/2010 |
| JP | 2011128514 | A | * | 6/2011 |
| JP | 2012198342 | A | | 10/2012 |

* cited by examiner

IMAGE FORMING APPARATUS WITH DEVELOPER BEARING MEMBER VELOCITY CONTROL

BACKGROUND OF THE INVENTION

1. Field of the Invention

The present invention relates to an image forming apparatus such as a copying machine, a printer, and a facsimile.

2. Description of the Related Art

As an existing image forming apparatus, there has been proposed an apparatus using a developing device of a cleaner-less system, which removes a cleaning device in order to downsize the apparatus, and performs cleaning of a photosensitive drum (image bearing member) by a developing sleeve (developer bearing member) at the same time as developing (Japanese Patent Laid-Open No. 2001-215798, and Japanese Patent Laid-Open No. 2001-215799).

FIG. 10 is a configuration diagram of the existing developing device of the cleaner-less system. As in FIG. 10, in the developing device of the cleaner-less system, a counter developing method is generally used in which a direction of rotation Ra of a developing sleeve 4*b* and a direction of rotation Rb of a photosensitive drum 1 are opposite at an opposing portion (developing area) of the developing sleeve 4*b* and the photosensitive drum 1. Accordingly, at the opposing portion, two-component developer carried on the developing sleeve 4*b* physically scrapes off a transfer residual toner on the photosensitive drum 1, and increases recovery of the transfer residual toner.

In a developing device 4 of the counter developing method, however, the developer carried on the developing sleeve 4*b* receives a force in the opposite direction of a conveying direction of the developing sleeve 4*b* at the opposing portion. When this force in the opposite direction becomes large, the developer fails to be conveyed in the conveying direction of the developing sleeve 4*b*, whereby the developer on the developing sleeve 4*b* is retained near the opposing portion. Once the retention occurs, it may lead to an image defect such as adhesion of carrier and contamination inside the body of the image forming apparatus caused by the developer overflowed from the developing device 4.

One of such cases in which the retention actually occurs is when an amount of the developer carried on the developing sleeve 4*b* (hereinafter, referred to as M/S) exceeds an appropriate range relative to a set value of a closest distance between the developing sleeve 4*b* and the photosensitive drum 1 (hereinafter, referred to as S-D gap).

Such a situation often occurs when the developing sleeve 4*b* is driven at a lower speed. For example, transfer materials such as thick paper (basis weight of 150 g/m$^2$ or above) and an OHT has a larger heat capacity than plain paper (basis weight from 60 g/m$^2$ to 130 g/m$^2$), whereby fixability in fixing a toner to the transfer material is inferior. Therefore, when performing image forming on these transfer materials, a process speed of the image forming apparatus should be set at a lower speed than that for the plain paper.

Furthermore, even though a developer M/S is within an appropriate range when the developing sleeve 4*b* is driven at a normal speed, the developer M/S may exceed an upper limit of the appropriate range when the developing sleeve 4*b* is driven at a lower speed.

Furthermore, a position of a magnetic pole of a magnet roller 4*c* fixedly disposed in the developing sleeve 4*b* at the opposing portion also affects the retention of the developer. The developer carried on the developing sleeve 4*b* forms a magnetic brush along a line of magnetic force formed by the magnet roller 4*c* on a surface of the developing sleeve 4*b*.

Generally, a peak of magnetic flux density (developing pole) of the magnet roller 4*c* is often disposed in the vicinity of the opposing portion. At this time, just above or near the developing pole, the line of magnetic force extends in a vertical direction from the surface of the developing sleeve 4*b*. Then, as a distance from the developing pole becomes larger, the line of magnetic force formed on the surface of the developing sleeve 4*b* gradually comes down to a tangential direction of the developing sleeve 4*b*. Therefore, the force received by the developer in the opposite direction of the conveying direction at the opposing portion, or a force that hinders movement of the developer, is the largest just above the developing pole, and becomes weaker with distance from the developing pole.

The retention is more likely to occur when the force received by the developer in the opposite direction of the conveying direction at the opposing portion is large. Occurrence of the retention may be restrained by shifting the developing pole to a downstream or upstream side of a closest position of the developing sleeve 4*b* and the photosensitive drum 1. In Japanese Patent No. 4065481, the occurrence of the retention is restrained by shifting the developing pole 15 degrees to the downstream side of the closest position of the developing sleeve 4*b* and the photosensitive drum 1 at the opposing portion.

However, the technique in Japanese Patent No. 4065481 has a risk of decreasing image quality of an output image.

Just above and near the developing pole, the magnetic brush on the surface of the developing sleeve 4*b* is standing along the line of magnetic force, and an amount of developer per unit volume on the surface of the developing sleeve 4*b* is non-dense. Therefore, when a developing bias is applied, the toner existing in between a tip of the magnetic brush and near the surface of the developing sleeve 4*b* flies to the side of photosensitive drum 1, whereby a moving efficiency of the toner is high.

On the other hand, the magnetic brush on the surface of the developing sleeve 4*b* at a position away from the developing pole is lying down on the surface of the developing sleeve 4*b* along the line of magnetic force, and the amount of developer per unit volume on the surface of the developing sleeve 4*b* is dense. Therefore, it is difficult for the toner near the surface of the developing sleeve 4*b* to fly to the side of photosensitive drum 1, whereby the moving efficiency of the toner is low.

Therefore, in a case where the developing pole is shifted as in Japanese Patent No. 4065481, the moving efficiency of the toner at the opposing portion is low. Such a phenomenon noticeably appears when the developer deteriorates due to durability and the toner parting properties with the carrier declines, whereby an image defect such as insufficient density of a solid image or poor coarseness occurs.

Therefore, it is desirable for an image forming apparatus of the counter developing method according to an embodiment of the present invention to provide the image forming apparatus capable of stably forming a high-quality image without causing the retention in the vicinity of the opposing portion of the developer bearing member and the image bearing member, even in a case where the image forming is performed by driving the developer bearing member at a lower speed than in the normal speed.

SUMMARY OF THE INVENTION

To solve the above problem, a representative configuration of an image forming apparatus according to an embodiment of the present invention includes: an image bearing member configured to carry an electrostatic latent image; and a developer bearing member configured to carry a two-component developer including a toner and a carrier, and develop an electrostatic latent image on the image bearing member into a toner image, in which moving directions of the image bearing member and the developer bearing member are opposite to each other at an opposing portion of the developing device. The image forming apparatus further includes: a speed changing portion configured to change a driving speed of the developer bearing member; and a controller configured to switch a target speed of the developer bearing member so that a rotating speed of the developer bearing member is driven at a second velocity, which is larger than a first velocity, before being driven at the first velocity set in a lower speed mode, when the lower speed mode, in which a rotating speed of the image bearing member is driven at a lower speed than in normal image forming, is executed.

The image forming apparatus of the counter developing method according to the embodiment of the present invention is capable of stably forming the high-quality image without causing the retention in the vicinity of the opposing portion of the developer bearing member and the image bearing member even in the case where the image forming is performed by driving the developer bearing member at a lower speed than the normal speed.

Further features of the present invention will become apparent from the following description of exemplary embodiments with reference to the attached drawings.

DESCRIPTION OF THE EMBODIMENTS

Figure 1:
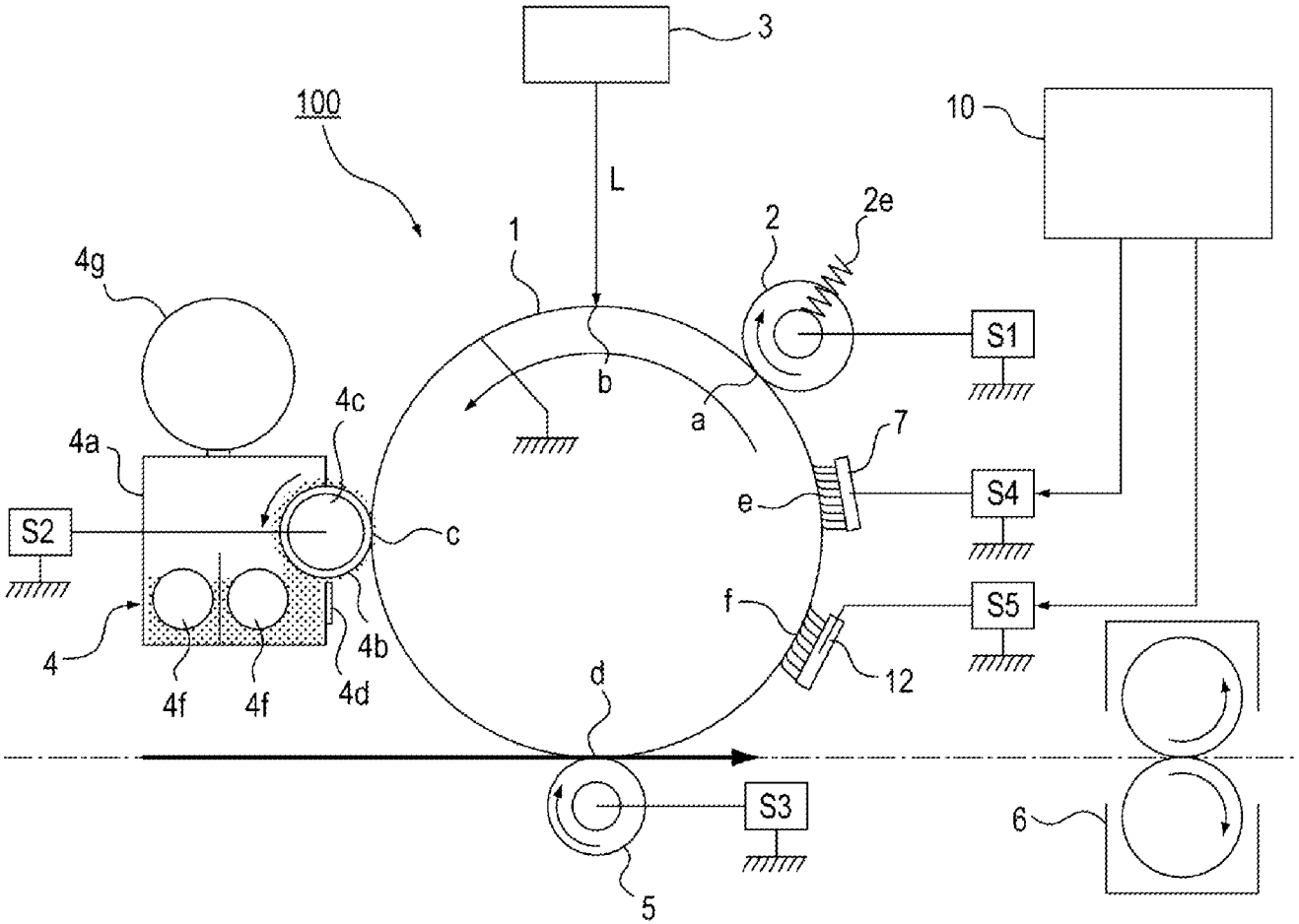
FIG. 1 is a configuration diagram of an image forming apparatus according to a first embodiment.

[First Embodiment] A first embodiment of an image forming apparatus according to the present invention is described herein using the drawings. FIG. 1 is a configuration diagram of the image forming apparatus according to this embodiment. As in FIG. 1, an image forming apparatus 100 according to this embodiment is the image forming apparatus of an electrophotographic system employing a contact charging method, a two-component contact developing method, a counter developing method, and a cleaner-less system.

In the image forming apparatus 100, a photosensitive drum (image bearing member) 1 is electrically charged by a charging roller 2, exposed to a laser beam L according to image information by an exposure device 3, and formed an electrostatic latent image thereon. The electrostatic latent image formed thereon is developed into a toner image by a developing sleeve (developer bearing member) 4*b* of a developing device 4 using a toner.

On the other hand, a sheet P housed in a cassette (not illustrated) is conveyed to a nip portion (transfer portion d) between the photosensitive drum 1 and a transfer roller 5 by a conveying roller, where the toner image is transferred thereon. The sheet P, on which the toner image has been transferred, is heated and pressurized by a fixing device 6, is fixed the toner image thereon, and is discharged to outside the apparatus. After the toner image has been transferred, the toner remaining on a surface of the photosensitive drum 1 is removed from the surface of the photosensitive drum 1 by the cleaner-less system (a residual toner uniformizing unit 12, a toner charging amount controlling unit 7, and the developing device 4).

(Developing device 4) The developing device 4 includes a developing container 4*a*, the developing sleeve 4*b*, a magnet roller 4*c*, and a developer regulating blade 4*d*. The developing container 4*a* houses two-component developer 4*e*, and a developer agitating member 4*f* is disposed inside the developing container 4*a* at the bottom thereof. The two-component developer 4*e* includes a non-magnetic toner and a magnetic carrier, which are agitated by the developer agitating member 4*f*.

The developing sleeve 4*b* is rotatably arranged inside the developing container 4*a* with a peripheral surface thereof partially exposed to outside the developing device 4. The magnet roller 4*c* is non-rotatably fixed inside the developing sleeve 4*b*. A developer regulating blade 4*d* is provided opposing the developing sleeve 4*b*. A supplementary toner is housed in a toner hopper 4*g*.

The developing sleeve 4*b* is disposed closely and opposingly to the photosensitive drum 1 by maintaining a closest distance (S-D gap) of 300 μm with the photosensitive drum 1. A developing portion c is an opposing portion of the photosensitive drum 1 and the developing sleeve 4*b*.

The developing sleeve 4*b* is rotary driven in an opposite direction of the moving direction of the photosensitive drum 1 at the developing portion c. By a magnetic force of the magnet roller 4*c* inside the developing sleeve 4*b*, a part of the two-component developer 4*e* in the developing container 4*a* is adsorbed and held on a peripheral surface of the developing sleeve 4*b* as a magnetic brush layer. This magnetic brush layer is rotary conveyed along with the rotation of the developing sleeve 4*b*, and formed into a predetermined thin layer by the developer regulating blade 4*d*. Then, the magnetic brush layer comes in contact with the surface of the photosensitive drum 1, and conveyed thereon at the developing portion c.

At the opposing portion of the developing sleeve 4*b* and the photosensitive drum 1, from a perspective of high image quality, it is desirable that a peak position of magnetic flux density of the magnet roller 4*c* be on or near a straight line connecting a central point of the developing sleeve 4*b* and a central point of the photosensitive drum 1. Practically, it is desirable that the peak position be in the range of ten degrees on the downstream side to ten degrees on the upstream side, and more preferably, in the range of five degrees on the downstream side to five degrees on the upstream side in the direction of rotation of the developing sleeve 4*b*. In this embodiment, the peak position of the magnetic force of the magnet roller 4*c* is positioned two degrees on the downstream side of the straight line connecting the central point of the developing sleeve 4*b* and the central point of the photosensitive drum 1.

A predetermined developing bias is applied to the developing sleeve 4*b* from a power source S2 (developing bias applying portion). In this embodiment, the developing bias applied to the developing sleeve 4*b* is an oscillating voltage of a direct current voltage (Vdc) and an alternating current voltage (Vac) superimposed on each other. Specifically, it is a square wave having a direct current component Vdc=−400V, a frequency of the alternating current voltage (developing alternating current bias) f=12.3 kHz, and an amplitude Vpp=1.65 kV, and is configured to repeat two cycles of application and two cycles of blankness.

A toner in the two-component developer 4*e*, which is conveyed to the developing portion c by the developing sleeve 4*b*, adheres to an exposure light portion of the electrostatic latent image formed on the photosensitive drum 1 by an electric field of the developing bias, whereby the electrostatic latent image is reversely developed into the toner image.

(Cleaner-less system) The image forming apparatus 100 of this embodiment employs the so-called cleaner-less system, and therefore has no cleaning device dedicated for removing a transfer residual toner remaining on the photosensitive drum 1 after the toner image has been transferred onto the sheet P.

Therefore, the image forming apparatus 100 according to this embodiment includes the residual toner uniformizing unit 12 and the toner charging amount controlling unit 7. The residual toner uniformizing unit 12 and the toner charging amount controlling unit 7 are brush members having moderate conductivity disposed so as to contact with the surface of the photosensitive drum 1 at their respective brush portions.

The residual toner uniformizing unit 12 is provided on the downstream side of the transfer portion d in the direction of rotation of the photosensitive drum 1. The toner charging amount controlling unit 7 is provided on the downstream side of the residual toner uniformizing unit 12 in the direction of rotation of the photosensitive drum 1 and on the upstream side of the charging portion a in the direction of rotation of the photosensitive drum 1.

The transfer residual toner not transferred onto the sheet P at the transfer portion d and remained on the photosensitive drum 1 is a mixture of a reversal toner and a toner with an inappropriate charging amount. Therefore, static electricity of the transfer residual toner is removed once by the residual toner uniformizing unit 12, and then the transfer residual toner is recharged with regular polarity (negative polarity) by the toner charging amount controlling unit 7. Accordingly, adhesion of the transfer residual toner to the charging roller 2 is effectively prevented.

Furthermore, an electric charge of the transfer residual toner is adjusted to a proper charging amount by applying a direct current voltage and an alternating current voltage by the charging roller 2. Accordingly, the transfer residual toner can be completely removed and recovered by the developing device 4, whereby development of the transfer residual toner as a ghost image is prevented.

Figure 2:
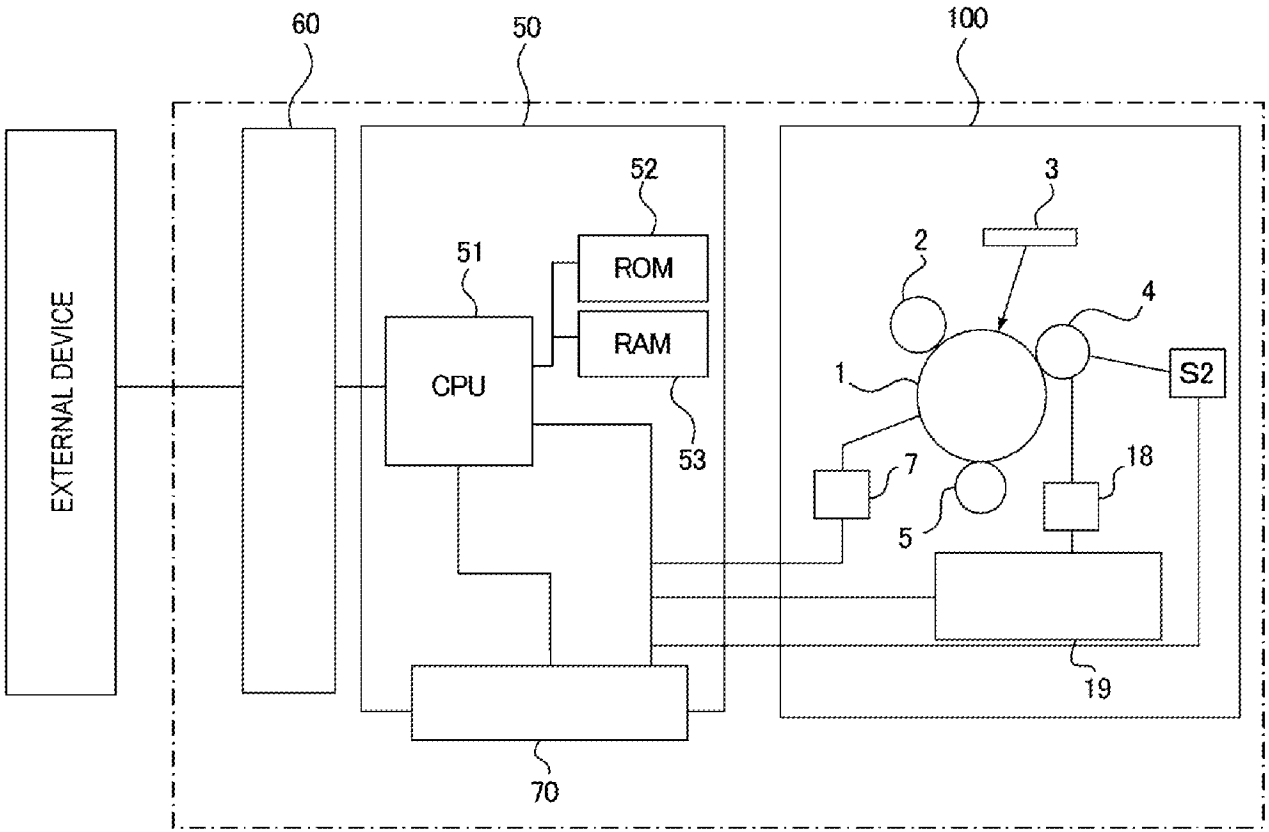
FIG. 2 is a block diagram of a controller of the image forming apparatus according to the first embodiment.

(Controller) FIG. 2 is a block diagram of a controller 50 of the image forming apparatus 100 according to this embodiment. As in FIG. 2, the controller 50 of the image forming apparatus 100, having a CPU 51, controls operation of each portion of the image forming apparatus 100 by using a program and data stored in a ROM 52 and a RAM 53.

A speed changing portion 8 changes the driving speed (rotating speed) of the photosensitive drum 1 in response to a signal from the CPU 51. The speed changing portion 19 changes the rotating speed of a developing motor 18 in response to the signal from the CPU 51, and changes the driving speed of the developing sleeve 4*b*.

The controller 50 is connected to an image processing portion 60. The image processing portion 60 receives an image signal from an external device such as a personal computer, and a document reading device, and sends a signal pertaining to image forming to the controller 50. The controller 50 controls the operation of each portion of the image forming apparatus 100 according to the image forming signal. Furthermore, an operation portion 70 such as a display unit and a key is provided to a body of the image forming apparatus. The operation portion 70 is connected to the CPU 51 of the controller 50.

The controller 50, in a case where a lower speed mode is executed in which the rotating speed of the photosensitive drum 1 is driven at a lower speed than in normal image forming, switches a target speed of the developing sleeve 4*b* so that the rotating speed of the developing sleeve 4*b* is driven at a second velocity, which is larger than a first velocity, before driving at the first velocity set in the lower speed mode.

(Control of the driving speed of the developing sleeve 4*b*) The rotating speed of the photosensitive drum 1 is changed by the speed changing portion 8 according to a type of the sheet P and an image forming mode. The rotating speed of the photosensitive drum 1 in this embodiment is set to 135 mm/sec (normal speed) for a plain paper (basis weight between 60 g/m$^2$ and 130 g/m$^2$) onto which the normal image forming is performed. For thick paper (basis weight between 131 g/m$^2$ and 200 g/m$^2$) and in a high-quality (1200 dpi) mode, the rotating speed is set to 67.5 mm/sec (1/2 speed), which is a lower speed than in the normal image forming. For super-thick paper (basis weight of 201 g/m$^2$ or above) and an OHT sheet, the rotating speed is set to 45 mm/sec (1/3 speed), which is a speed even lower than in the normal image forming.

In this embodiment, to obtain high developability, the developing sleeve 4*b* is rotated at a speed of 1.7 times the speed of the photosensitive drum 1. An external diameter of the developing sleeve 4*b* according to this embodiment is ϕ18 mm, and at the normal speed in which the photosensitive drum 1 is rotated at 135 mm/sec, the developing sleeve is rotated at 229.5 mm/sec (=243 rpm). At the 1/2 speed in which the photosensitive drum 1 is rotated at 67.5 mm/sec, the developing sleeve is rotated at 114.8 mm/sec (=121.5 rpm). At the 1/3 speed in which the photosensitive drum 1 is rotated at 45 mm/sec, the developing sleeve is rotated at 76.5 mm/sec (=81 rpm).

Timing of driving the photosensitive drum 1 and the developing sleeve 4*b*, and timing of applying the developing bias according to this embodiment is described herein. FIGS. 3A to 4B are graphs illustrating the timing of driving the photosensitive drum 1 and the developing sleeve 4*b*, respectively, timing of applying the developing bias, and a change of the developer M/S on the developing sleeve 4*b*, until the image forming is started.

FIGS. 3A to 4A are graphs illustrating cases where the image forming is performed at the normal speed (1/1 speed) and in lower speed modes (1/2 speed and 1/3 speed) according to this embodiment. FIG. 4B is a graph illustrating a comparative example in which the image forming is performed at the 1/3 speed, in which the driving of the developing sleeve 4*b* is not started at the normal speed but at the 1/3 speed.

Figure 3A:
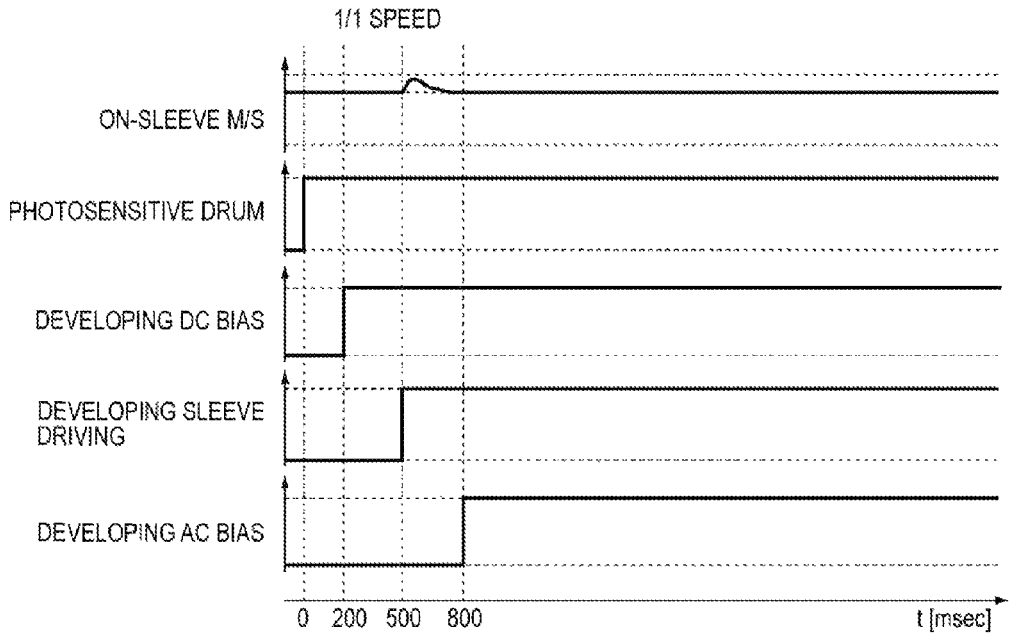
FIGS. 3A and 3B are graphs illustrating timing of driving a photosensitive drum and a developing sleeve, timing of applying a developing bias, and a change of a developer M/S on the developing sleeve, until image forming is started on the image forming apparatus according to the first embodiment.
Figure 3B:
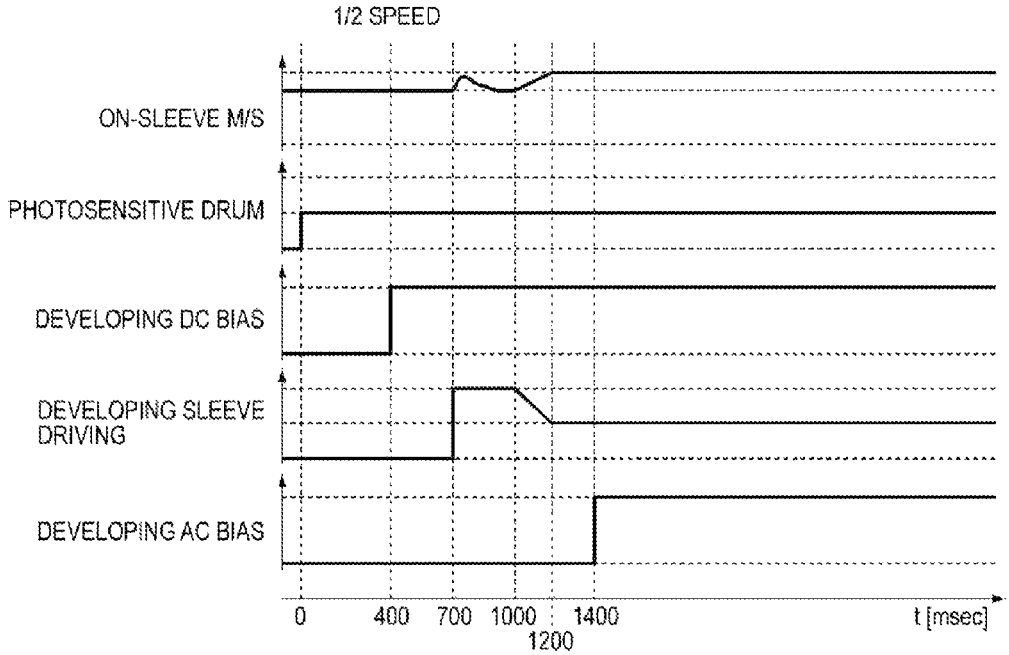
Figure 4A:
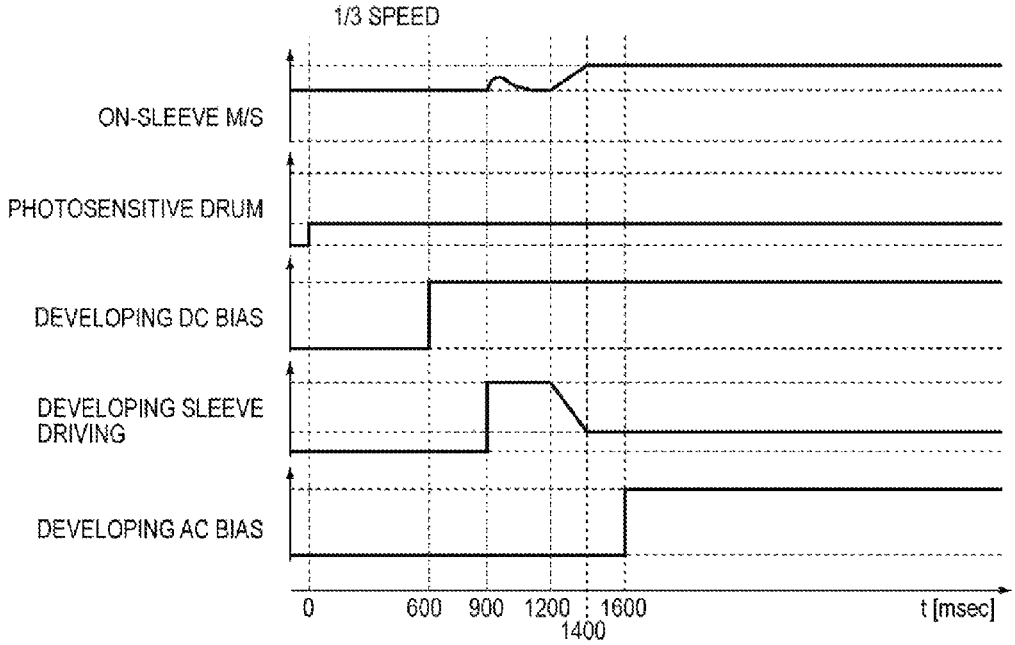
FIG. 4A is a graph illustrating the timing of driving the photosensitive drum and the developing sleeve, the timing of applying the developing bias, and the change of the developer M/S on the developing sleeve, until the image forming is started on the image forming apparatus according to the first embodiment.

As in FIGS. 3B and 4A, in this embodiment, the driving of the developing sleeve 4*b* is started at the normal speed (second velocity), which is then decelerated to a lower speed (1/2 speed or 1/3 speed), or the first velocity. In the comparative example in FIG. 4B, the developing sleeve 4*b* is rotated at the lower speed (1/2 speed or 1/3 speed) from the beginning.

Figure 4B:
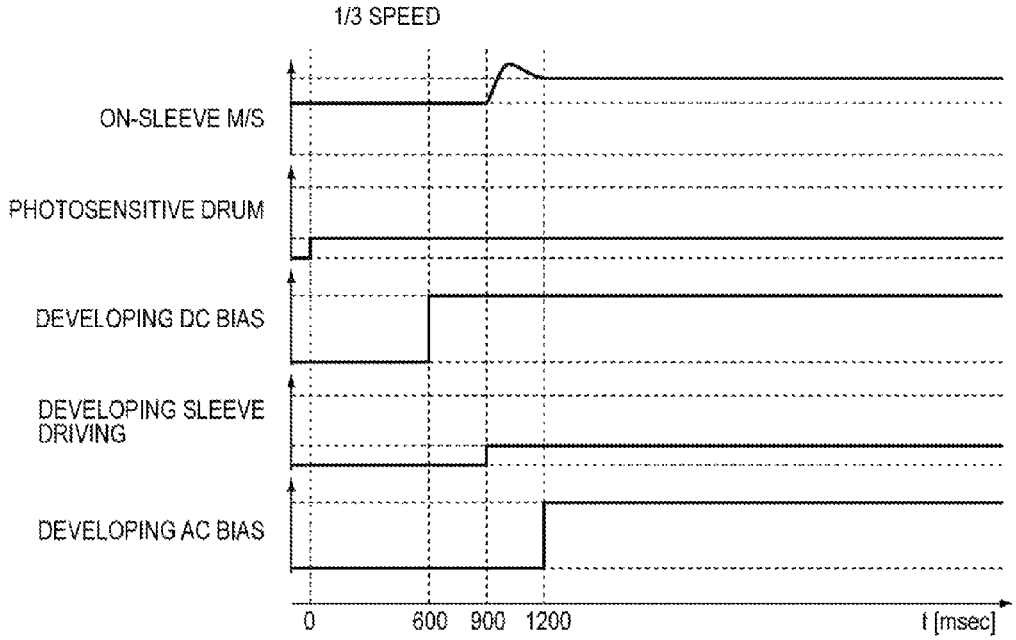
FIG. 4B is a graph illustrating the timing of driving the photosensitive drum and the developing sleeve, the timing of applying the developing bias, and the change of the developer M/S on the developing sleeve, until the image forming is started on the image forming apparatus of a comparative example.

Comparing a control in this embodiment in FIG. 4A and the comparative example in FIG. 4B, a maximum value of the developer M/S on the developing sleeve 4*b* can be made smaller in the case where the driving of the developing sleeve 4*b* is started at the normal speed, and then the driving is decelerated to the 1/3 speed as in the control according to this embodiment.

Figure 5:
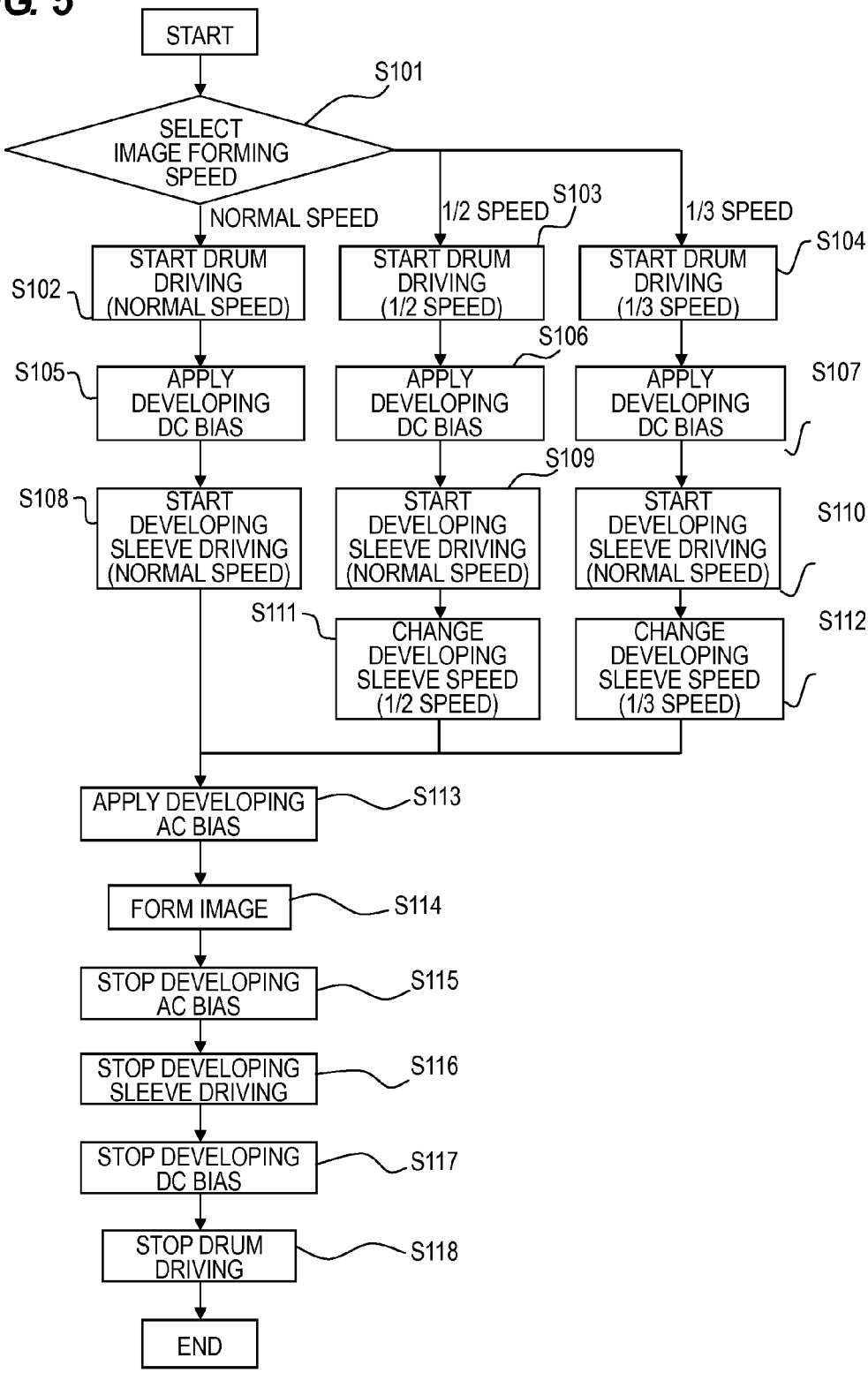
FIG. 5 is a flowchart illustrating a control flow of a driving speed of the developing sleeve according to the first embodiment.

FIG. 5 is a flowchart illustrating the control flow of the driving speed of the developing sleeve 4*b* according to this embodiment. As in FIG. 5, when an image forming operation is started, the CPU 51 selects an image forming speed from the normal speed, the 1/2 speed, or the 1/3 speed according to a command from the operation portion 70 (S101).

Next, the CPU 51 sends a signal for driving the photosensitive drum 1 at the speed determined in Step 101 (normal speed, 1/2 speed, or 1/3 speed) (from S102 to S104). Subsequently, when a position on the photosensitive drum charged with a dark electrical potential (Vd) by the charging roller 2 reaches the opposing portion with the developing device 4, a developing direct current bias is applied so as to form a fog-removing potential (Vback) by a potential difference between the photosensitive drum 1 and the developing sleeve 4*b* (from S105 to S107).

Then, the CPU 51 sends a signal for starting the driving of the developing sleeve 4*b* at the normal speed (from S108 to S110). Then, only in the case where the image forming is performed in the lower speed mode (1/2 speed or 1/3 speed), 300 msec after S109 and S110, a signal is sent from the CPU 51 for decelerating the driving speed of the developing sleeve 4*b* (S111 and S112). At this time, the rotating speed of the developing sleeve 4*b* is linearly decreased from the normal speed to the 1/2 speed in the case of the 1/2 speed, and from the normal speed to the 1/3 speed in the case of the 1/3 speed, respectively, over a period of 200 msec. In this embodiment, a rate of a circumferential speed of the photosensitive drum to a circumferential speed of the developing sleeve is the same in each image forming speed in a steady state after the developing sleeve has been decelerated.

The CPU 51 sends a signal for applying the developing alternating current voltage 300 msec after the driving start of the developing sleeve in S102 in the normal speed, and 400 msec after the start of S111 and S112 in the lower speed developing (S113).

After an image has been formed (S114), the CPU 51 sends a signal for stopping the developing alternating current voltage (S115), a signal for stopping the driving of the developing sleeve 4*b* (S116), a signal for stopping the developing direct current bias (S117), and a signal for stopping the driving of the photosensitive drum 1 (S118). A series of image forming has been completed through the above flow.

In the image forming apparatus according to this embodiment, a DC brushless motor is used as the developing motor 18. The speed of the developing motor 18 is changed by applying a predetermined voltage to the developing motor 18 and changing a speed designation signal input from the CPU 51 to the speed changing portion 19.

The speed designation signal according to this embodiment is a pulse signal, which alternately applies 0V and 5V. In the normal speed, a signal of 1.5 kHz frequency is input to the speed changing portion 19, and in the 1/2 speed, a signal of 750 Hz frequency is input to the speed changing portion 19, continuously while the developing motor 18 is driven. By receiving the signal and determining the frequency thereof, the speed changing portion 19 changes the timing for applying an electric current to a plurality of coils arranged inside the DC brushless motor, and changes the rotating speed of the developing motor 18.

In a case where the rotary driving of the developing sleeve 4*b* of the developing device 4 is performed by the developing motor 18 according to this embodiment, the time from the start of applying a voltage by the developing motor to stabilization at the target speed has been the following. That is, a period of 200 msec was necessary to reach the normal speed of 243 rpm from a stopped state. In a case where the DC brushless motor is used, compared to the case where a stepping motor is used, the stability of speed 200 msec after reaching an intended rotating speed is weak, and a speed variation of about ±5% may occur. It may be assumed as reaching a stable speed when the speed variation is within ±10%. Note that there is little change in the developability even if such a level of variations occurs to the rotating speed of the developing sleeve.

Figure 8:
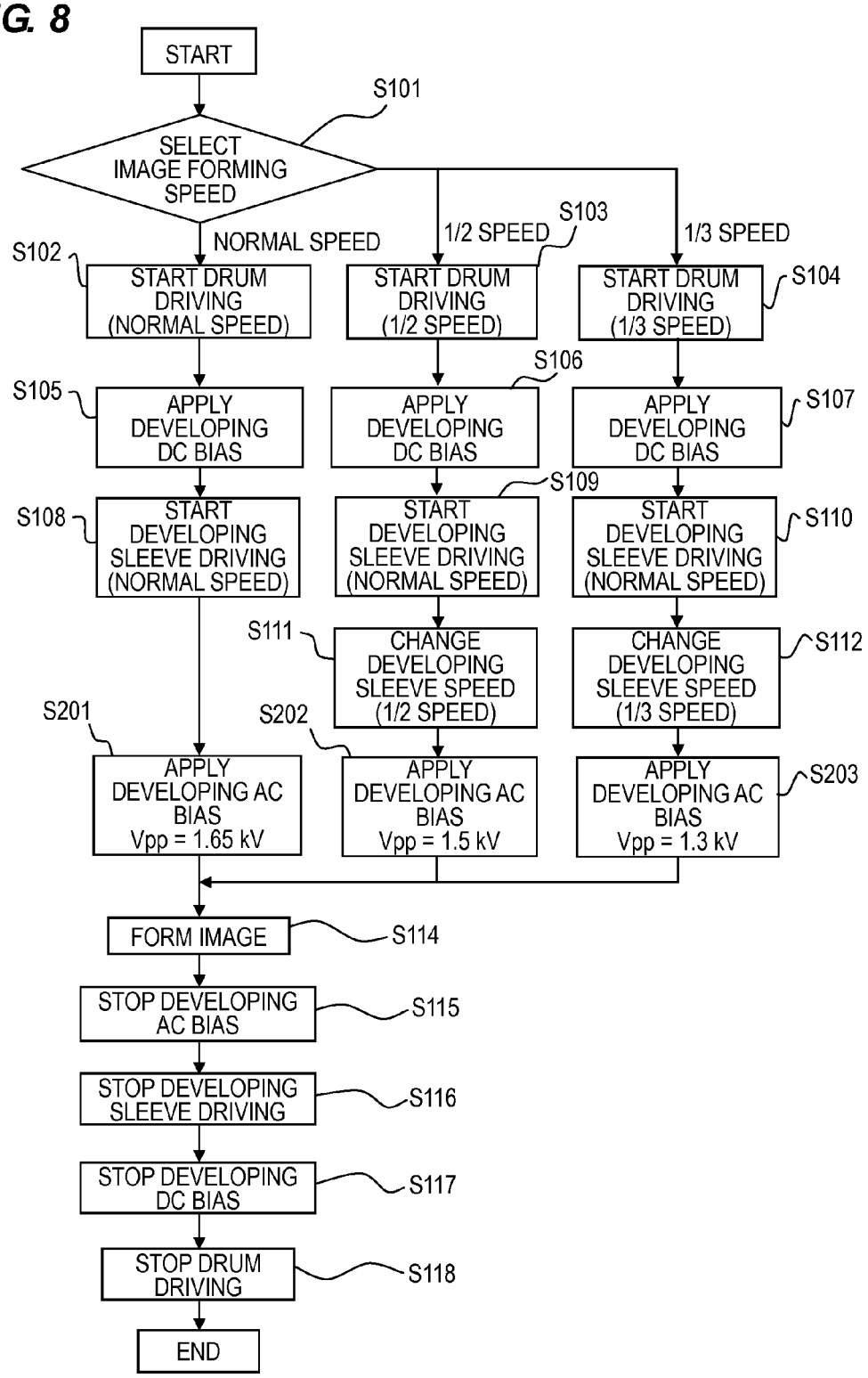
FIG. 8 is a control flowchart according to a second embodiment.

In S109 and S110 in FIG. 8 of a control according to this embodiment, the time to drive the developing sleeve in the normal speed setting is 300 msec. Since it takes 200 msec to reach the normal rotating speed of the developing motor, it has been made sure to switch to the rotating speed of 1/2 speed or the 1/3 speed after reaching the normal rotating speed.

(Retention restraining mechanism) Next, a mechanism for restraining the retention of the developer in the opposing portion of the developing sleeve 4*b* and the photosensitive drum 1 by the driving speed control of the above-described developing sleeve 4*b* is described herein.

Figure 6A:
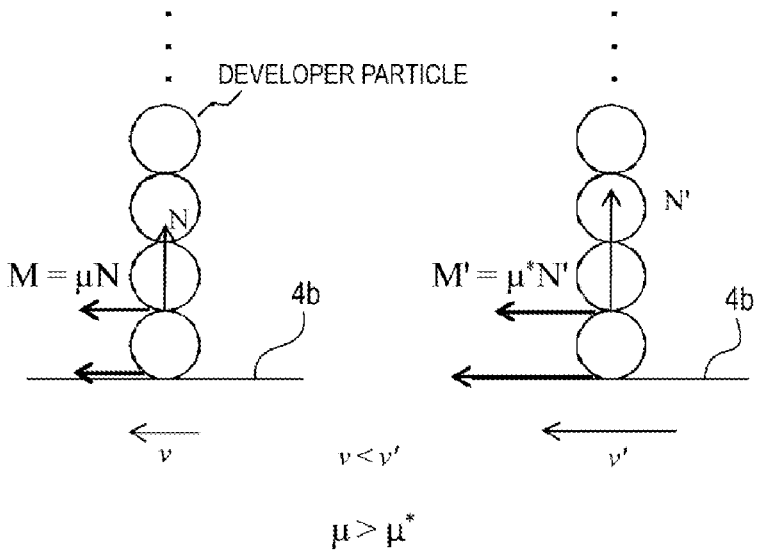
FIG. 6A is a schematic view of a force in a conveying direction applied to a developer carried on the developing sleeve.
Figure 6B:
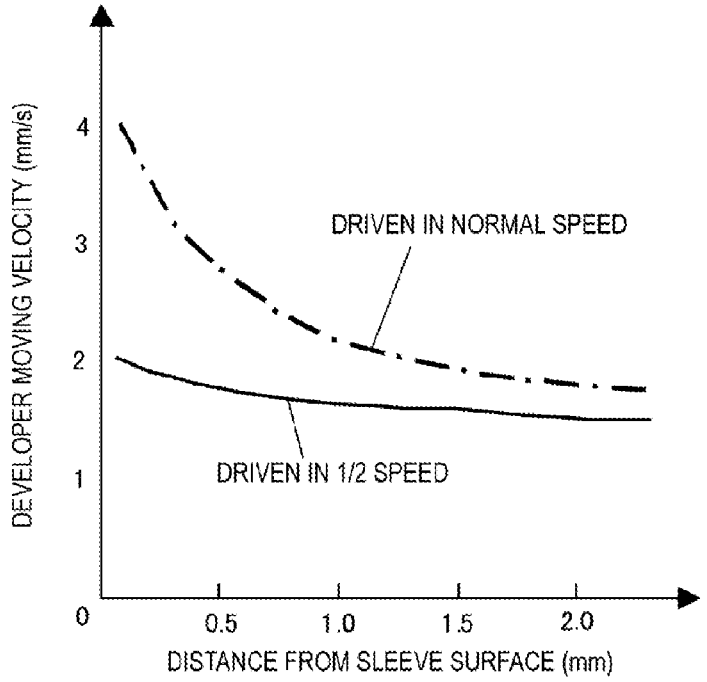
FIG. 6B is a graph illustrating a relationship between a moving velocity of two-component developer on the developing sleeve and a distance from a surface of the developing sleeve.

FIG. 6A is a schematic view of a force in a conveying direction applied to the developer carried on the developing sleeve 4*b*. FIG. 6B is a graph illustrating a relationship between a distance of the developer carried on the developing sleeve 4*b* from a surface of the developing sleeve 4*b* in a part where the developer moves thereon until passing the developer regulating blade 4*d* (developer returning portion), and a moving velocity of the developer.

As in FIG. 6A, when the developing sleeve 4*b* is rotating, a developer particle existing on the surface of the developing sleeve 4*b* transmits the propulsive force in the conveying direction to a vertically-adjacent developer particle in a moving direction of the developer.

When the developing sleeve 4*b* rotates at a relatively lower speed (for example, 1/2 speed), it is unlikely that slipping or rolling occurs to these developer particles. Therefore, a static friction force acts on these developer particles, and the adjacent developer particle moves in the conveying direction at a speed similar to the developer particle on the side near the developing sleeve 4*b*.

As the rotating speed of the developing sleeve 4*b* becomes large, the moving velocity of the developer particle on the surface of the developing sleeve 4*b* becomes large, whereby the slipping or rolling is more likely to occur between the developer particle on the surface of the developing sleeve 4*b* and the vertically-adjacent developer particle. When the slipping or rolling occurs between these developer particles, a kinetic friction force, which is smaller than the static friction force, acts between these developer particles, whereby the moving velocity of the adjacent developer particle in the direction of rotation of the developing sleeve 4*b* becomes smaller compared to that of the developer particle on the side near the developing sleeve 4*b*.

Therefore, as in FIG. 6B, when the driving speed of the developing sleeve 4*b* is large (in the normal speed driving), compared to when the driving speed is small (in the 1/2 speed driving), the rate of reduction of the developer moving velocity relative to the distance from the surface of the developing sleeve becomes larger. That is, as the rotating speed of the developing sleeve 4*b* becomes larger, an efficiency of transmitting the propulsive force in the direction of rotation of the developing sleeve from the developer positioned near the developing sleeve 4*b* to the developer positioned far from the developing sleeve 4*b* is reduced, whereby the developer M/S is reduced.

Furthermore, when the developing sleeve 4*b* is once moved at a large speed, the friction force acting on the developer particles is maintained at a low level even if the speed of the developing sleeve 4*b* is decreased subsequently. Therefore, by rotating the developing sleeve 4*b* at the normal speed for a predetermined time even during the lower speed developing, it is possible to reduce the efficiency of transmitting the propulsive force from the developer particle on the side near the developing sleeve 4*b* to the developer particle on the side far therefrom. Then, even if the rotating speed of the developing sleeve 4*b* is subsequently decreased to the 1/2 speed or the 1/3 speed, a state with reduced efficiency of transmitting the propulsive force can be maintained, whereby the state is realized in which the efficiency of transmitting is sufficiently lower than in a level where an increase of the developer M/S may cause the retention.

Figure 7:
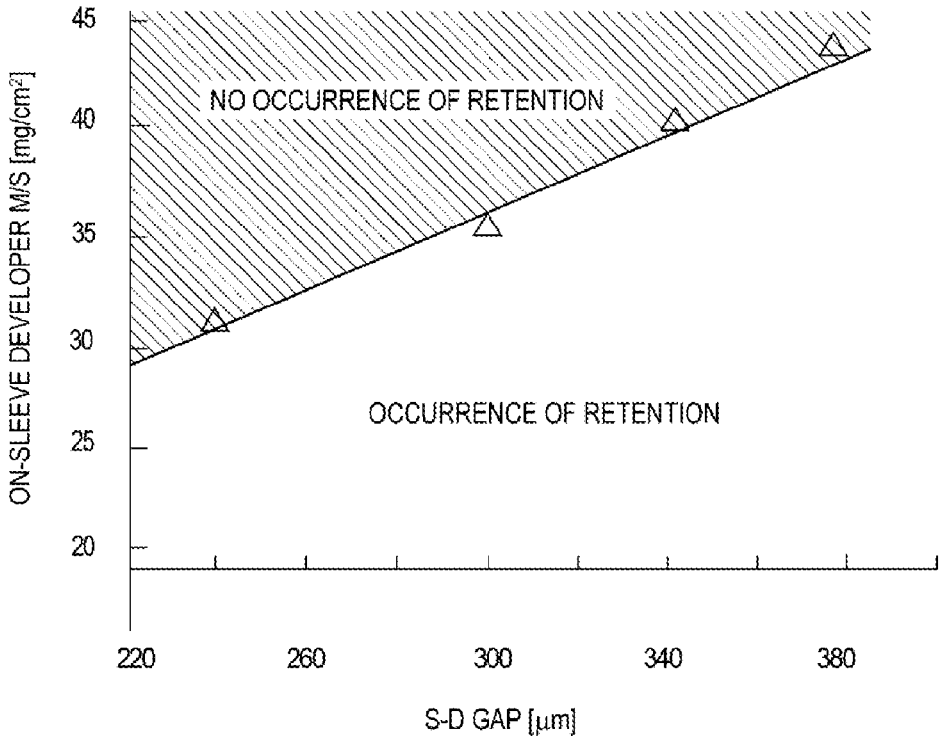
FIG. 7 is a graph illustrating a relationship among an S-D gap, the developer M/S on the developing sleeve, and retention of the developer.

FIG. 7 is a graph illustrating a relationship among the closest distance between the developing sleeve 4*b* and the photosensitive drum 1 (S-D gap), the developer M/S on the developing sleeve, and the retention of the developer. In FIG. 7, a shaded area above a solid line denotes a condition in which the retention of the developer occurs in the developing portion c.

As in FIG. 7, when the S-D gap is narrow, the retention occurs even if an amount of developer carried on the developing sleeve is small. When the S-D gap is wide, the retention is unlikely to occur even if an amount of developer carried is large. In other words, when the S-D gap is narrow, conveyance of the developer in contact with and developing on the photosensitive drum 1 is hindered, and the amount of developer conveyed by passing through the S-D gap becomes smaller than the amount of developer conveyed to the developing portion c, whereby the developer is retained in the developing portion c and causes the retention.

(Experiment) To check an effect of this embodiment, an experiment to find out whether or not the retention occurs was carried out by performing image forming of a solid white image on 20 sheets consecutively, in the image forming mode of the following Examples 1 to 3 and Comparative Example, for ten times respectively. In Examples 1 to 3, image forming was performed in the control of this embodiment in FIGS. 3A to 4A (in the normal speed, 1/2 speed, and 1/3 speed). In Comparative Example, image forming was performed in the control in FIG. 4B (always in the 1/3 speed).

As a result of this experiment, in the control of this embodiment (Examples 1 to 3), no retention occurred in ten times, whereas in Comparative Example, the retention occurred three times out of ten times. Therefore, compared to Comparative Example, the control in this embodiment is effective for restraining occurrence of the retention. Note that when image forming was performed at the 1/3 speed in the control in FIG. 4A, a maximum value of the developer M/S on the developing sleeve was 32 mg/cm$^2$, whereas the value increased to 37 mg/cm$^2$ in the control in FIG. 4B.

As described above, in the image forming apparatus of the counter developing method according to this embodiment, it is possible to restrain the occurrence of the retention in the vicinity of the opposing portion of the developing sleeve 4*b* and the photosensitive drum 1 even in the case where the image forming is performed by driving the developing sleeve 4*b* at a lower speed than the normal speed. Accordingly, a high quality image can be formed stably.

Note that the speed of the developing sleeve 4*b* is not limited to the above-described set speed. Any speed may be used as long as the retention is restrained by changing a target speed of the developing sleeve 4*b* such that a rotating speed of the developing sleeve 4*b* is driven at a third velocity, which is larger than the second velocity, before being driven at the second velocity set in the lower speed mode, when executing the lower speed mode in which the rotating speed of the photosensitive drum 1 is driven at the lower speed than in the normal image forming. Furthermore, the DC brushless motor has been used as the developing motor 18 in this embodiment, but needless to say, the same effect may be obtained by using a stepping motor as an alternative for controlling the rotating speed of the developing sleeve by controlling an applied electric current and a clock frequency.

[Second Embodiment] A second embodiment of an image forming apparatus according to the present invention is described herein by using the drawings. Note that any part same as in a description in the above-described first embodiment is denoted with the same reference numeral, and the description is omitted. FIG. 8 is a control flow according to this embodiment.

As in FIG. 8, an image forming apparatus 100 of this embodiment is the image forming apparatus 100 according to the above first embodiment that is changed an amplitude (Vpp) of the alternating current component of the developing bias (developing alternating current bias) when the image forming is performed at a lower speed (lower speed mode). Note that the image forming apparatus 100 of this embodiment is changed the rotating speed when the developing sleeve 4*b* starts driving, and the timing to start applying the developing bias, in the same way as the image forming apparatus 100 according to the above first embodiment.

Then, at the normal speed, the CPU 51 sends a signal for applying a Vpp=1.65 kV developing alternating current voltage 300 msec after the driving start of the developing sleeve in S102 (S201). In the lower speed developing (1/2 speed), the CPU 51 sends a signal for applying a Vpp=1.5 kV developing alternating current voltage 400 msec after the start of S111 (S202). In the lower speed developing (1/3 speed), the CPU 51 sends a signal for applying a Vpp=1.3 kV developing alternating current voltage 400 msec after the start of S112 (S203).

As in FIG. 2, in this embodiment, the CPU 51 changes the developing bias applied from the power source S2 according to the image forming mode. In the above first embodiment, the amplitude (Vpp) of the developing alternating current bias is fixed to 1.65 kV, but it is changed according to the image forming mode in this embodiment. Specifically, Vpp is changed to 1.65 kV at the normal speed, 1.5 kV at the 1/2 speed, and 1.3 kV at the 1/2 speed in this embodiment.

The developing alternating current bias is superimposed onto the direct current component in order to give a driving force to a toner of the two-component developer on the developing sleeve 4*b* so that it flies to the photosensitive drum 1. The driving force given by the developing alternating current bias becomes higher as the amplitude (Vpp) of the developing alternating current bias becomes larger. In the two-component developer, however, due to frictional charging between a carrier and the toner, the toner is charged with negative polarity and the carrier is charged with positive polarity. Therefore, there is timing for the developing alternating current bias to give the propulsive force to the side of the photosensitive drum 1 also to the carrier, whereby the effect thereof becomes larger as the Vpp becomes larger.

In the developing portion c, when the propulsive force to the side of the photosensitive drum 1 acts on the carrier, the speed of the developer carried and conveyed by the rotary drive of the developing sleeve 4*b* is decreased in the tangential direction of the developing sleeve 4*b*. Therefore, it becomes difficult for the developer to pass through the developing portion c, whereby retention is more likely to occur.

Figure 9:
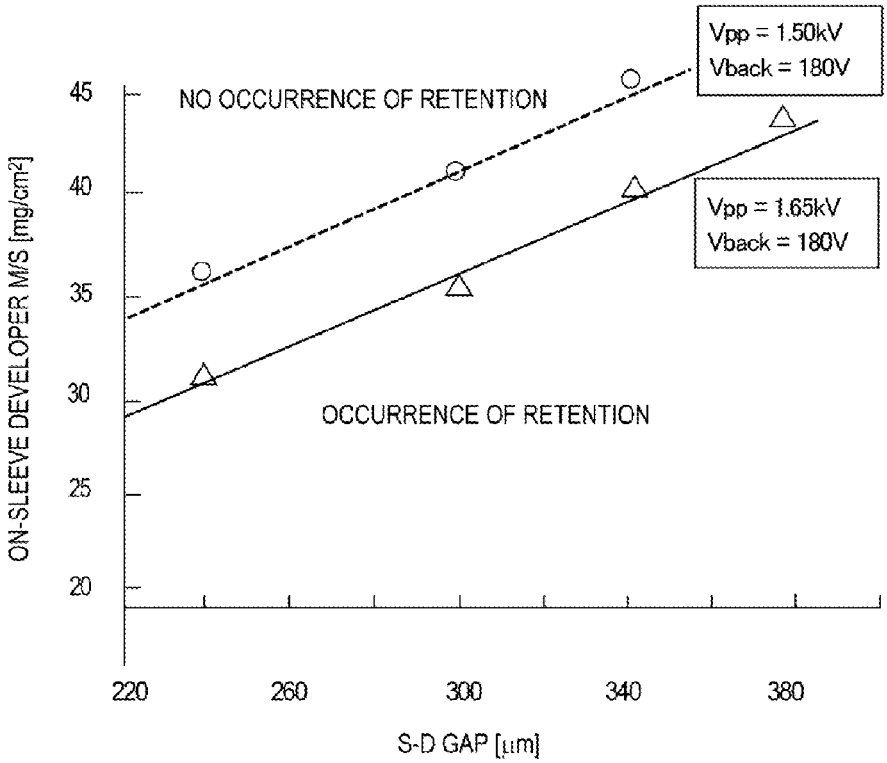
FIG. 9 is a graph illustrating the relationship among the S-D gap, the developer M/S on the developing sleeve, and the retention of the developer with a different Vpp of developing alternate current bias.
Figure 10:
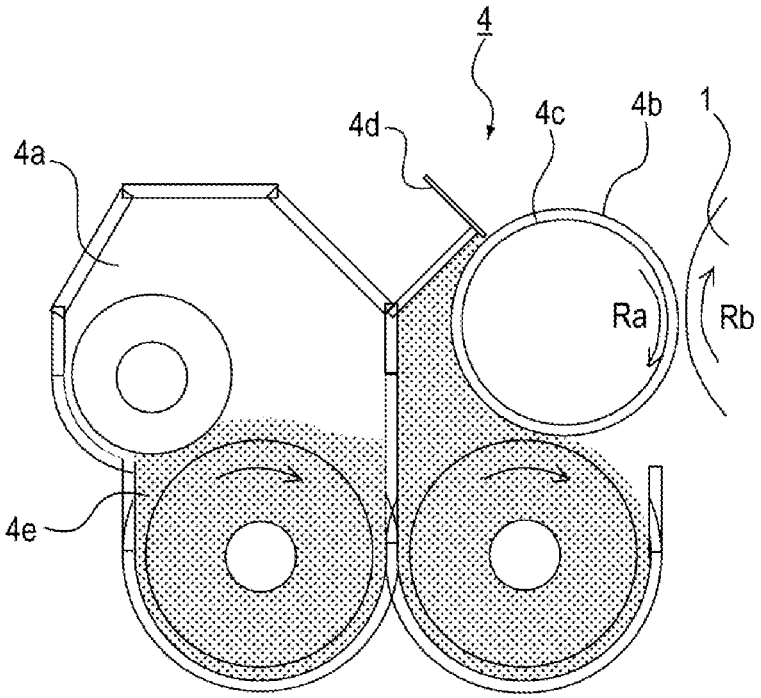
FIG. 10 PRIOR ART
FIG. 10 is a configuration diagram of a developing device employing an existing counter developing method.

FIG. 9 is a graph illustrating a relationship among the S-D gap, the developer M/S on the developing sleeve, and the retention of the developer in the different Vpp of the developing alternating current bias in the developing device 4 according to this embodiment. As in FIG. 9, when the Vpp of the developing alternating current bias is changed from 1.65 kV to 1.5 kV, the retention of the developer does not occur even if the developer M/S on the developing sleeve is larger by 4 $mg/cm^2$. In other words, as the Vpp becomes smaller, it is less likely that retention of the developer may occur.

As described above, in the image forming apparatus of the counter developing method according to this embodiment, it is possible to restrain the occurrence of the retention in the vicinity of the opposing portion of the developing sleeve 4*b* and the photosensitive drum 1 even in the case where the image forming is performed by driving the developing sleeve 4*b* at a lower speed than the normal speed. Accordingly, a high quality image can be formed stably.

Note that the amplitude of the alternating current component of the developing bias is not limited to the above-described value. Any value may be used as long as the retention is restrained by making the amplitude of the alternating current component of the developing bias smaller than the amplitude of the normal image forming, when the rotating speed of the photosensitive drum 1 is driven at the lower speed than in the normal image forming.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-110628, filed May 14, 2012, which is hereby incorporated by reference herein in its entirety.

What is claimed is:

1. An image forming apparatus comprising:

an image bearing member configured to carry an electrostatic latent image;

a developer bearing member configured to carry a two-component developer including a toner and a carrier, and develop the electrostatic latent image on the image bearing member into a toner image; and a controller configured to selectively perform a first mode in which the developer bearing member rotates at a first peripheral speed during an operation of developing an electrostatic image and a second mode in which the developer bearing member rotates at a second peripheral speed lower than the first peripheral speed during an operation of developing an electrostatic image, wherein in a case that the controller performs the second mode from a status that the image bearing member is stopped, the controller sets a peripheral speed of the developer bearing member to a third peripheral speed which is greater than the second peripheral speed before performing the second mode.

2. The image forming apparatus according to claim 1, wherein moving directions of the image bearing member and the developer bearing member are opposite to each other at an opposing portion.

3. The image forming apparatus according to claim 1, further comprising a developing bias applying portion configured to apply a developing bias to the developer bearing member, wherein the controller controls an amplitude of an alternating current component of the developing bias to be smaller in the second mode than in the first mode.

4. The image forming apparatus according to claim 1, wherein in the second mode, the controller sets the peripheral speed of the image bearing member to be the same between a case that the peripheral speed of the developer bearing member is set to the second peripheral speed and a case that the peripheral speed of the developer bearing member is set to the third peripheral speed.

5. The image forming apparatus according to claim 4, wherein the controller sets a ratio of the peripheral speed of the image bearing member to the peripheral speed of the developer bearing member to be the same in the second mode as in the first mode.

6. The image forming apparatus according to claim 1, wherein an alternating current is applied to the developer bearing member, and the controller is configured to change the peripheral speed of the developer bearing member from the third peripheral speed before the alternating current is applied to the developer bearing member.

* * * * *